United States Patent [19]

Michetti

[11] Patent Number: 4,765,535

[45] Date of Patent: Aug. 23, 1988

[54] DECORATIVE PACKAGE WITH SIMULATED OVERWRAP

[75] Inventor: Louis C. Michetti, Santa Clara, Calif.

[73] Assignee: Container Corporation of America, Clayton, Mo.

[21] Appl. No.: 96,633

[22] Filed: Sep. 10, 1987

[51] Int. Cl.[4] ..... B65P 5/24; B65D 5/62

[52] U.S. Cl. ..... 229/172; 229/179; 229/40; 229/923

[58] Field of Search ..... 229/125.19, 165, 172, 229/178, 179, 40, 23 BT, 8, 87 R, 923, 16 R

[56] References Cited

U.S. PATENT DOCUMENTS

| | | | |
|---|---|---|---|
| 1,402,259 | 1/1922 | Smith | 229/40 |
| 1,841,222 | 1/1932 | Tennant | 229/40 |
| 1,856,282 | 5/1932 | Holy | 229/178 |
| 2,105,270 | 1/1938 | Scheffey | 229/40 |
| 2,220,076 | 11/1940 | Carruth | 229/179 |
| 2,769,588 | 11/1956 | Beck | 229/923 |
| 2,932,439 | 4/1960 | Sparling | 229/923 |
| 3,410,475 | 11/1968 | Wagner | 229/178 |
| 3,460,738 | 8/1969 | Adams, Jr. et al. | 229/923 |
| 3,869,076 | 3/1975 | Chally | 229/178 |
| 4,441,451 | 4/1984 | Neal | 229/178 |

FOREIGN PATENT DOCUMENTS

| | | | |
|---|---|---|---|
| 1237865 | 6/1971 | United Kingdom | 229/178 |

*Primary Examiner*—Stephen Marcus
*Assistant Examiner*—Gary E. Elkins
*Attorney, Agent, or Firm*—Richard W. Carpenter

[57] ABSTRACT

A decorative package that is formed from a pair of box-like, telescoping, paperboard, carton members, one of which has decorative paper covering one side thereof, so that when it is erected and placed over a similar, but uncovered member, a simulated over-wrapped package will be created.

3 Claims, 4 Drawing Sheets

DECORATIVE PACKAGE WITH SIMULATED OVERWRAP

BACKGROUND OF THE INVENTION

1. Field of the Invention

This invention relates to decorative packaging, and more particularly to a decorative package formed from a pair of telescoping, paperboard carton members, one of which includes a paperboard blank having decorative paper attached to one side thereof, so that when the blank is erected, it will have the appearance of a completely overwrapped package.

2. Description of the Prior Art

Applicant is unaware of any prior art patent which discloses or suggests a decorative package constructed and assembled in the same manner as the package of the present invention.

SUMMARY OF THE INVENTION

It is an object of the present invention to provide a decorative package that can be preformed to simulate a carton formed of paperboard which has been overwrapped with a sheet of decorative material such as paper or plastic.

A more specific object of the invention is the provision of a decorative package formed from a pair of telescoping, box-like paperboard members, one of which has a sheet of decorative material covering one side thereof and folded in such a manner as to simulate an overwrapped carton.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

In order to provide decorative packages of the type used for gifts, it is generally the practice to overwrap both the tray and cover members of a paperboard carton with decorative paper.

The present invention provides a means for providing a gift package with a simulated overwrap that can be formed from a pair of carton blanks which may be easily erected into telescoping members one of which has decorative paper attached to one side thereof and is folded in a manner that will create the the appearance of an overwrapped package.

Figure 1:
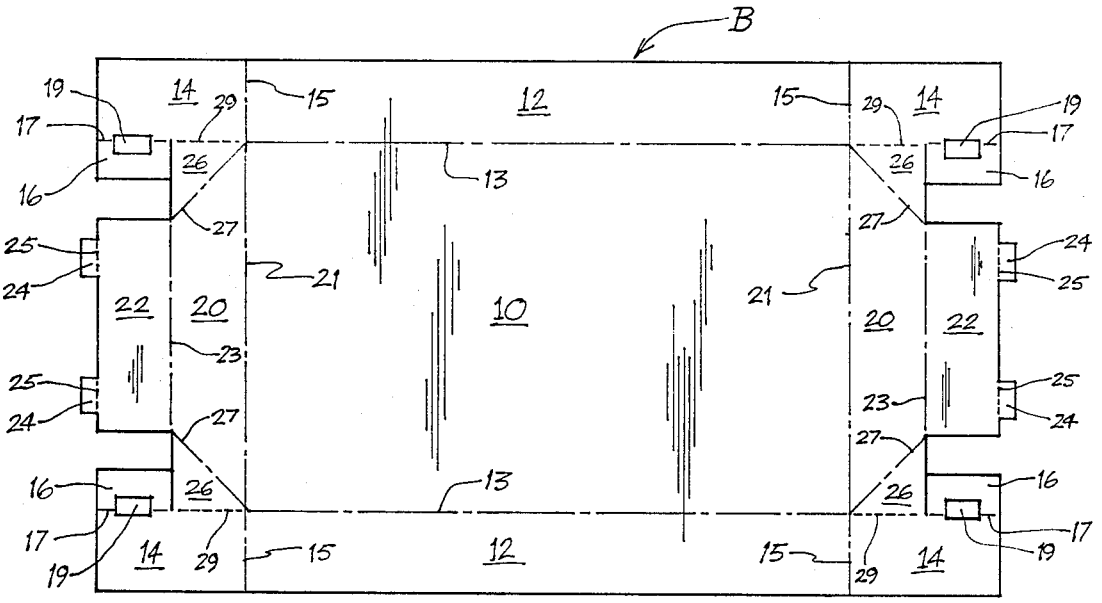
FIG. 1 is a plan view of a blank of foldable paperboard for use in forming a carton member embodying features of the present invention.
Figure 2:
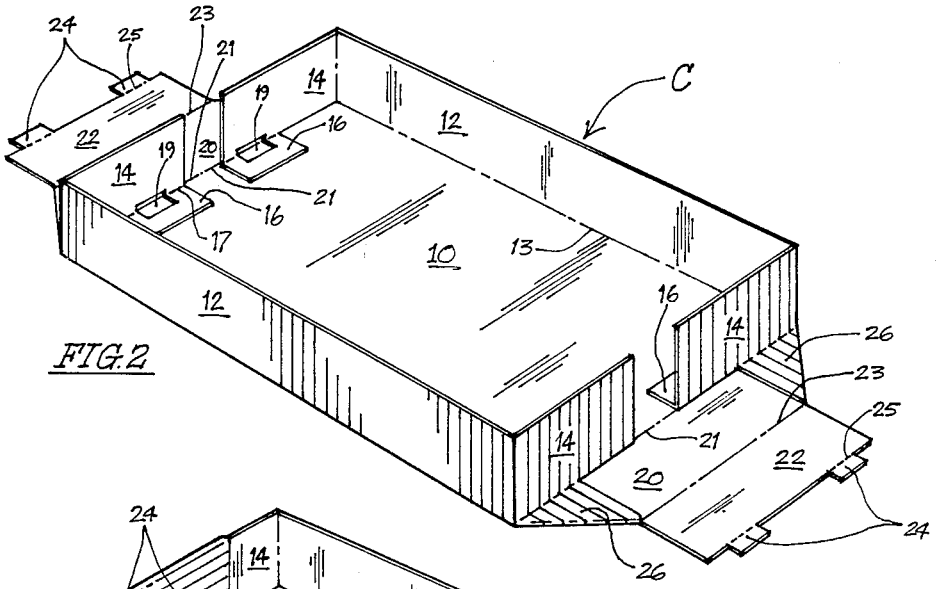
FIG. 2 is a perspective view illustrating the manner in which a carton member can be formed from the blank of paperboard illustrated in FIG. 1.
Figure 3:
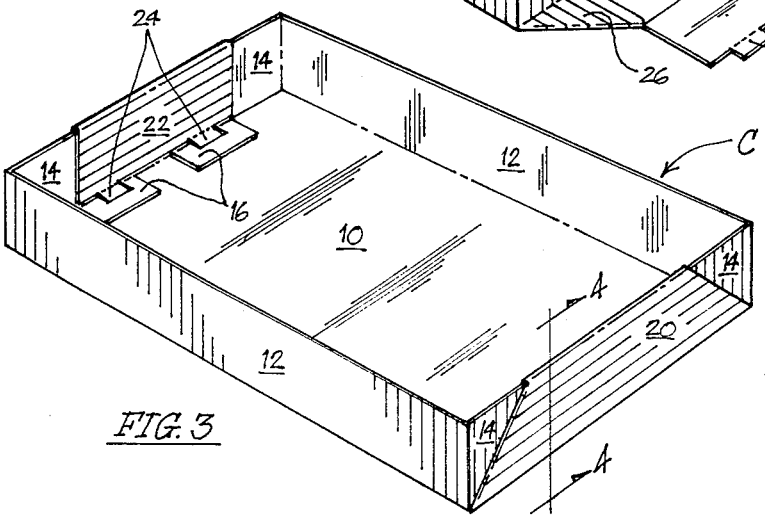
FIG. 3 is a perspective view of a fully erected carton member embodying features of the invention.
Figure 4:
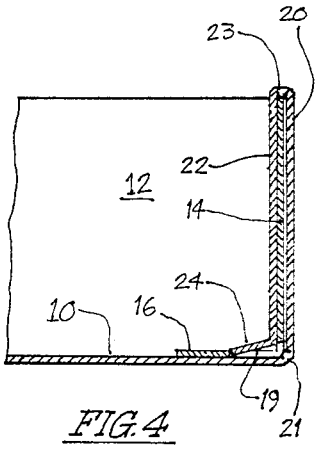
FIG. 4 is a fragmentary, vertical, sectional view taken on line 4—4 of FIG. 3.

Referring to the drawings for a better understanding of the invention, it will be seen that the box-type member indicated, generally at C in FIGS. 2–4, can be formed from a unitary blank B of foldable sheet material, such as paperboard, illustrated in FIG. 1.

Each of the carton tray and cover members includes a generally rectangular major wall 10, having pairs of opposed side and end walls joined to side and end edges thereof, and to each other, to form a box-like structure.

If the structure is to be used as a cover, one side will be covered with a decorative material, such as paper as seen in FIGS. 8–15; if it is to be used as a tray, it will be without paper, as shown in FIGS. 1–7. Any one of the structures illustrated can be used as either a tray or a cover member.

As best seen in FIGS. 1 and 2, the side walls include side wall panels 12 foldably joined to opposite sides of major wall 10 along a fold line 13.

The end walls each include an outer panel 20, foldably joined along fold line 21 to an end edge of major wall 10; an inner panel 22, foldably joined along fold line 23, to an outer edge of outer panel 20, and a pair of intermediate panels 14, foldably joined along fold lines 15, to corresponding end edges of side wall panels 12.

Each of the end wall intermediate panels 14 has foldably joined to an inner edge thereof, along a fold line 17, an anchor panel 16 having a lock tab receiving opening 19 located adjacent fold line 17.

As best seen in FIG. 2, end wall outer panels 20 are folded 90 degrees outwardly from major panel 10 and inner panels 22 are folded 180 degrees inwardly so as to be in parallel relationship with the outer panels 20 and with the related pairs of intermediate panels 14 sandwiched therebetween.

In order to maintain each end wall in erected condition there are provided a pair of lock tabs 24, foldably joined along fold lines 25 to each of the end wall inner panels 22. The lock tabs 24 are folded inwardly at right angles to the inner panel 22 and are received within openings 17 of related anchor panels 16.

For additional strength there is provided, at each corner of the carton, a generally triangular shaped web element 26 which is foldably joined along fold lines 27 and 29 to the adjacent edges of end wall outer panel 20 and intermediate panel 16, respectively. As best seen in FIG. 3, the web elements 26 are folded to lie against the inner surface of end wall outer panel 20.

Thus, it will be appreciated that the structure provides a means for securing the end wall to the side walls of the carton and for maintaining it in erected condition without the need for gluing, stapling or other outside securing means.

Figure 5:
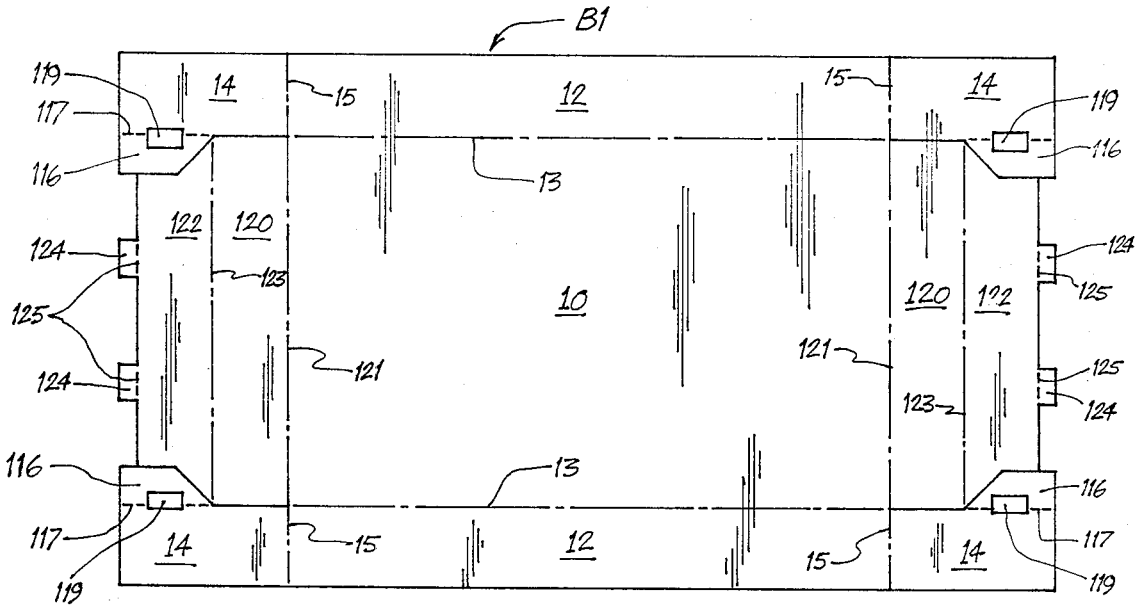
FIGS. 5, 6, and 7 are views similar to FIGS. 1, 2, and 3, but illustrate a modified form of the invention.
Figure 6:
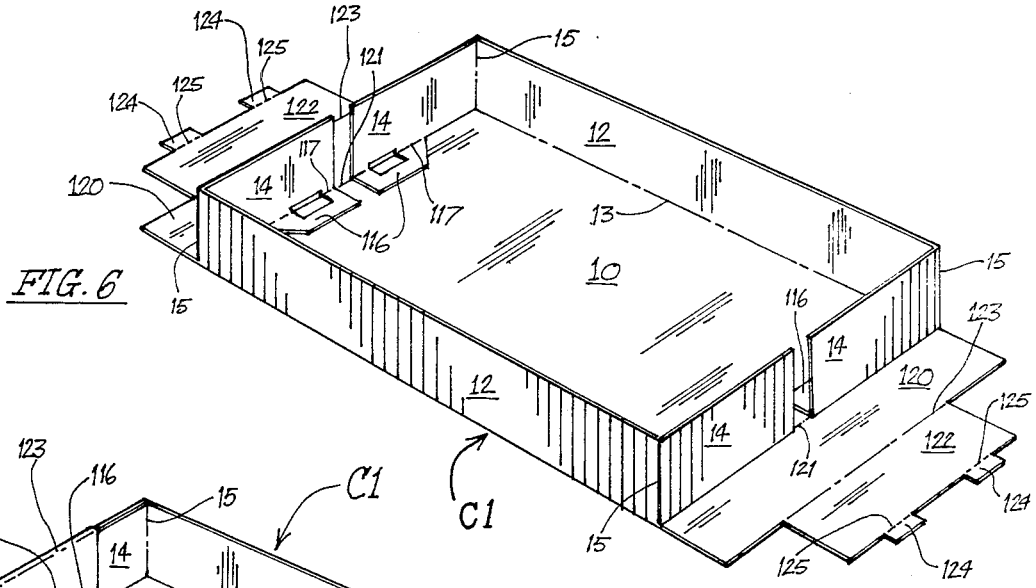
Figure 7:
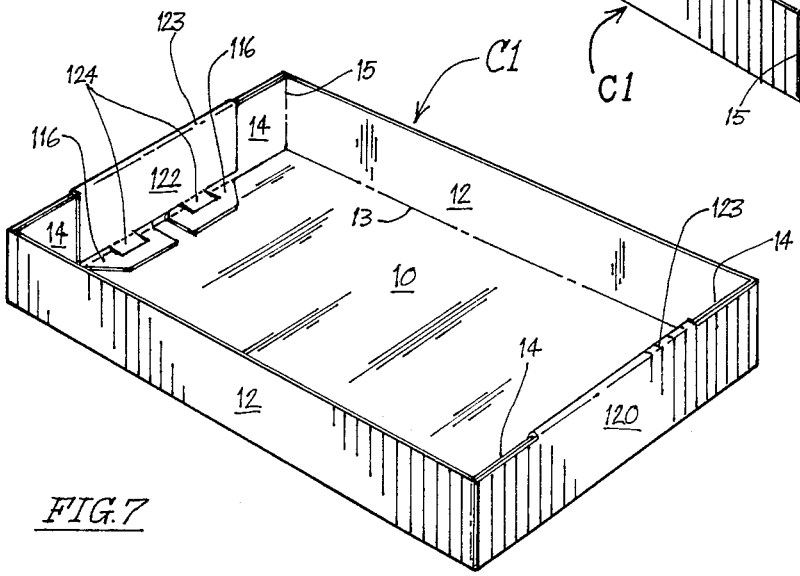

Now turning to FIGS. 5–7 of the drawings, it will be seen that a slightly modified form of the invention is shown.

In this embodiment portions of the structure which correspond to portions of the previously described structure are identified by related numerals.

The primary difference between this embodiment and the previously described embodiment resides in the fact that this embodiment does not have the paperboard corner webs of the previous embodiment, but instead the webs are in the paper portion of the carton member. Instead, the width of each end wall outer panel 120 is the same width as the major panel 10. Also, the side edges of the end wall inner panels 122 extend all the way to and abut the edges of related anchor panels 16.

It will be understood that the structures illustrated in FIGS. 1–4 and 5–7 are shown as tray members of the package; whereas, the structures illustrated in FIGS. 8–10 and 12–15 are shown as cover members of the composite package.

Figure 8:
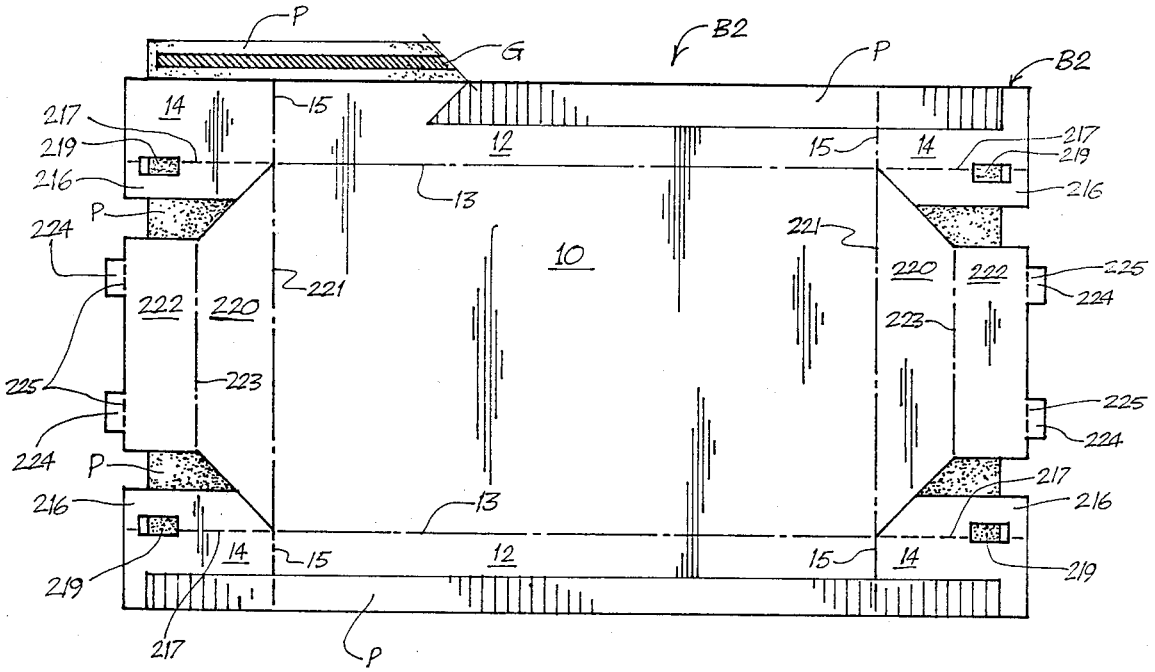
FIGS. 8, 9, 10, and 11 are views similar to FIGS. 1, 2, 3, and 4, respectively, but illustrate another embodiment of the invention.
Figure 9:
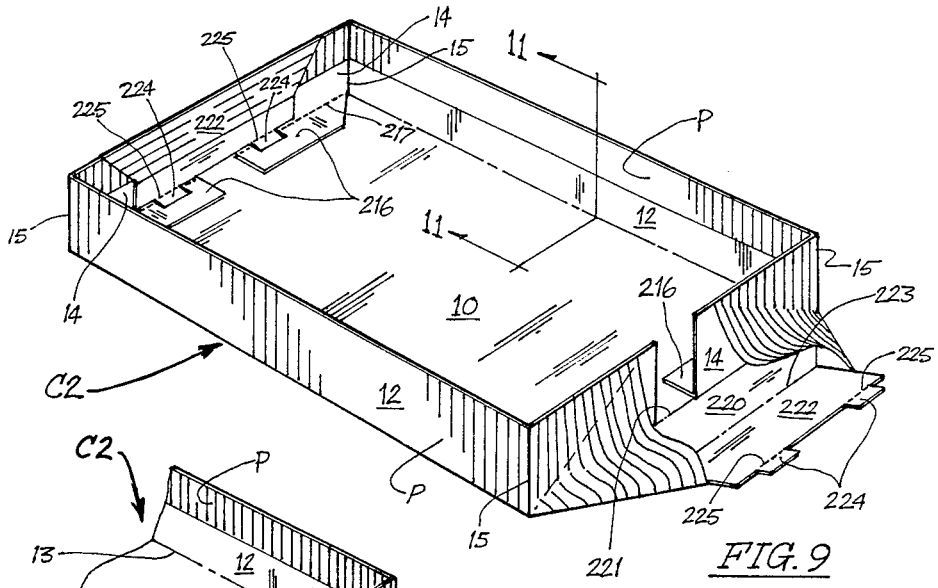
Figure 10:
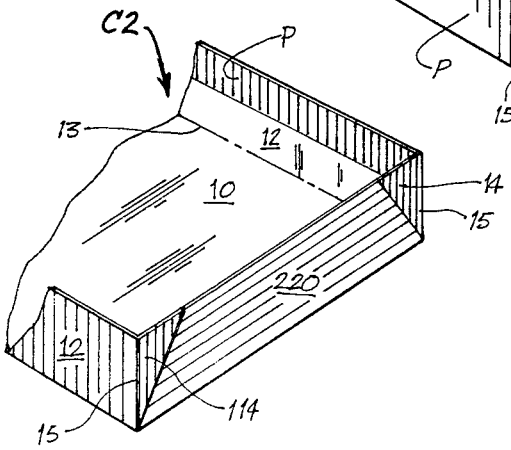

Referring now to the structure illustrated in FIGS. 8–10, it will be seen that the paperboard portion of the structure is quite similar to that illustrated in FIG. 1, except that there are no paperboard webs provided at the corners of the structure, but instead the webs are in the paper portion of the carton member and space is provided between the ends of the end wall inner panels 222 and related anchor panels 216.

Figure 11:
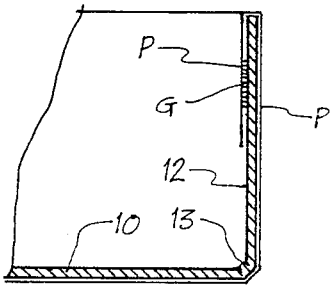
Figure 12:
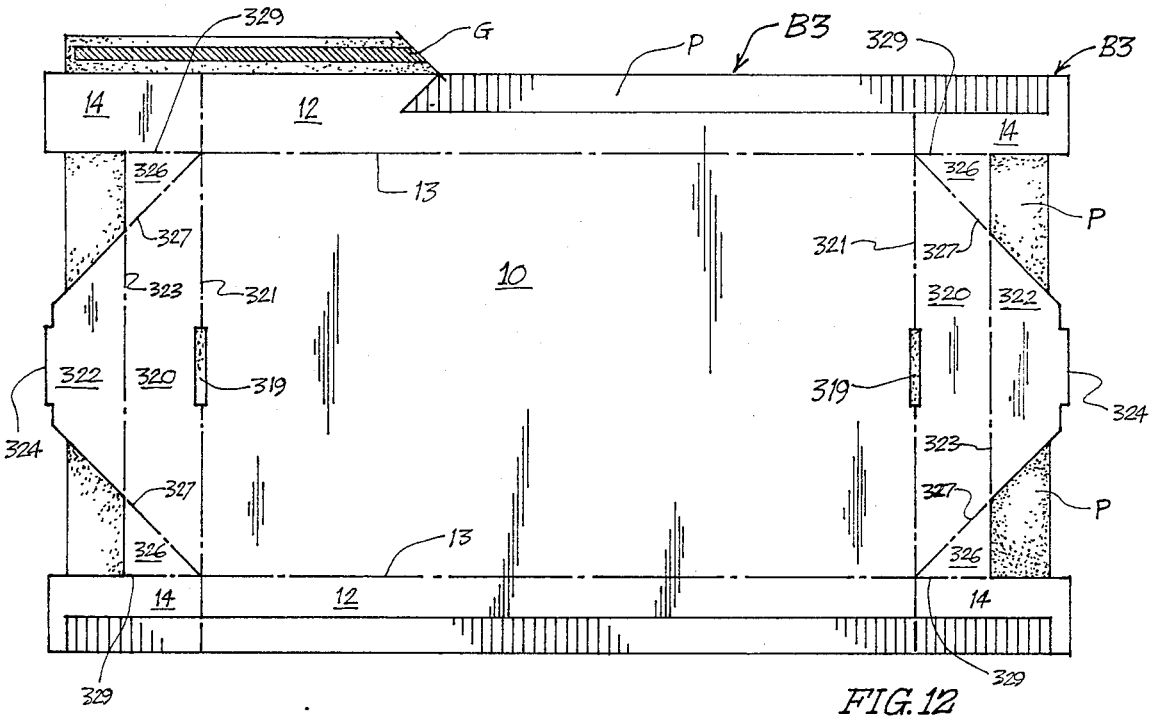
FIGS. 12, 13, and 14 are views similar to FIGS. 1, 2, and 3, respectively, but illustrate yet another embodiment of the invention.
Figure 13:
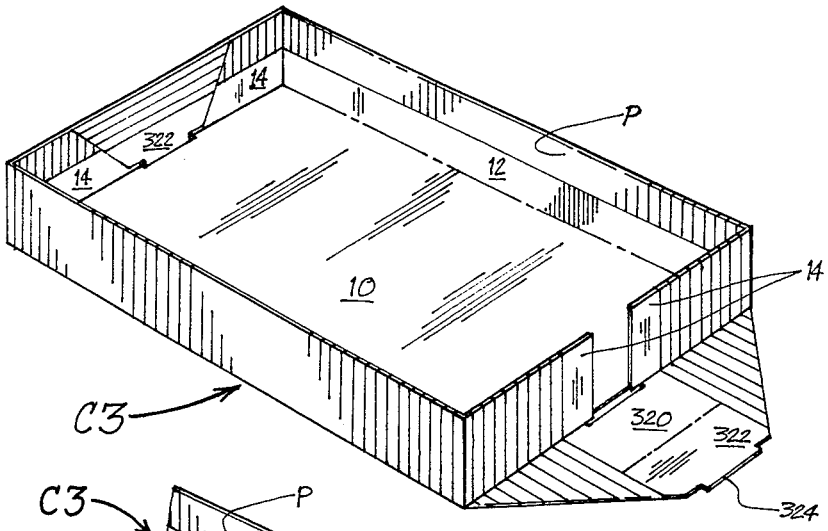
Figure 14:
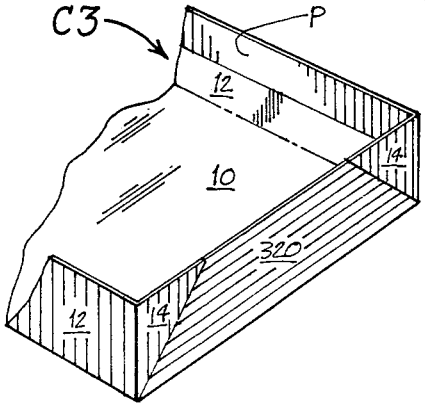
Figure 15:
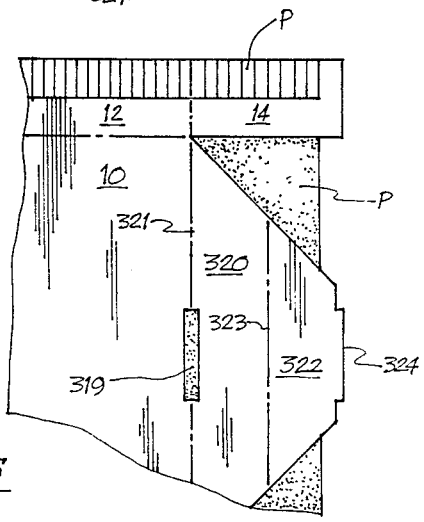
FIG. 15 is an enlarged fragmentary view of a portion of the structure of FIG. 12.

As best seen in FIG. 8, there is provided a decorative sheet of paper, indicated generally at P, which is disposed to cover practically the entire outer surface of the blank B2 of paperboard to form a composite blank. Portions of the sheet of paper are folded over and secured as at G by adhesive to the inner face of the paperboard, so that, when the carton cover member is folded into erected condition, as illustrated in FIGS. 9, 10, and 11, and is telescoped over an uncovered tray member, a simulated overwrapped package will be created.

Now turning to FIGS. 12–15, it will be seen that a slightly modified form of the invention is illustrated. In this embodiment the cover member of the package is similar to the structure illustrated in FIG. 1 and has corner webs 326 foldably joined along lines 327 and 329 to the related end wall outer panel 320 and intermediate panel 14.

In this arrangement there are no anchor panels, but the end wall is secured by means of lock tabs 324, which project from the end wall inner panels 322 and are adapted to be received within related openings 327 in the major wall 10 of the carbon adjacent fold line 321.

Thus, it will be appreciated that, with the present invention, great economy can be achieved without losing any esthetic value in decorative packages by forming the package from a pair of box-like body and cover members one of which one is covered with decorative paper to simulate a completely overwrapped package.

What is claimed is:

1. A carton member for a decorative package that includes a pair of telescoping carton members, said carton member being formed from a composite blank including a sheet of foldable paperboard and a sheet of decorative paper attached to said paperboard sheet, said carton member comprising:

(a) a major wall having pairs of opposed side and end walls joined to each other and to side and end edges of said major wall and extending normal to said major wall to form therewith a box-like structure;

(b) each of said end walls including:

(i) an outer panel having one end edge foldably joined to an end edge of said major wall and folded outwardly 90 degrees;

(ii) an inner panel foldably joined to an end edge of said outer panel opposite from said one edge and folded inwardly 180 degrees into parallel relation with said outer panel;

(iii) a pair of intermediate panels foldably joined to corresponding end edges of said side walls, folded inwardly 90 degrees, and interposed between said inner and outer panels;

(iv) a pair of generally triangular webs each being foldably joined along adjacent side edges to an outer side edge of a related end wall outer panel and to an inner side edge of a related end wall intermediate panel;

(c) said intermediate panels each having foldably joined, to an inner edge thereof, an anchor panel which is folded inwardly 90 degrees against an upper surface of said major wall and has an opening extending therethrough;

(d) said end wall inner panels each having a pair of lock tabs joined to a free end edge thereof and which are folded inwardly 90 degrees and received within openings of related anchor panels;

(e) said sheet of decorative paper being disposed to cover outer surfaces of said major, side, and end walls and being attached to inner surfaces of said side and end wall panels to simulate an overwrapped carton.

2. A carton member for a decorative package that includes a pair of telescoping carton members, said carton member being formed from a composite blank including a sheet of foldable paperboard and a sheet of decorative paper attached to said paperboard sheet, said carton member comprising:

(a) a major wall having pairs of opposed side and end walls joined to each other and to side and end edges of said major wall and extending normal to said major wall to form therewith a box-like structure;

(b) each of said end walls including:

(i) an outer panel having one end edge foldably joined to an end edge of said major wall and folded outwardly 90 degrees;

(ii) an inner panel foldably joined to an end edge of said outer panel opposite from said one edge and folded inwardly 180 degrees into parallel relation with said outer panel;

(iii) a pair of intermediate panels foldably joined to corresponding end edges of said side walls, folded inwardly 90 degrees, and interposed between said inner and outer panels;

(iv) a pair of generally triangular webs each being foldably joined along adjacent side edges to an outer side edge of a related end wall outer panel and to an inner side edge of a related end wall intermediate panel;

(c) said end wall inner panels each having at least one lock tab extending from a free end edge thereof and received within an opening located adjacent the juncture of said end wall and said major wall;

(d) said sheet of decorative paper being disposed to cover outer surfaces of said major, side, and end walls and being attached to inner surfaces of said side and end wall panels to simulate an overwrapped carton.

3. A composite blank of flexible sheet material for forming a carton cover member for a decorative package, said blank comprising a sheet of paperboard and a separate sheet of decorative material attached to said sheet of paperboard and disposed to cover substantially one side of said paperboard sheet and have marginal areas secured to marginal areas of a reverse side of said paperboard sheet, said blank being cut and scored to provide:

(a) a generally rectangular major wall panel;

(b) side wall panels foldably joined to opposite side edges of said major wall panel;

(c) end wall intermediate panels foldably joined to opposite end edges of said side wall panels;

(d) end wall outer panels foldably joined to opposite end edges of said major wall panel;

(e) end wall inner panels foldably joined to outer edges of said outer end wall panels;

(f) each of said end wall inner panels having a lock tab extending outwardly therefrom;

(g) a pair of generally triangular webs foldably joined along adjacent side edges to outer side edges of a related end wall outer panel and to inner side edges of related end wall intermediate panels.

* * * * *